US005944589A

United States Patent [19]

Nakajima

[11] Patent Number: 5,944,589

[45] Date of Patent: Aug. 31, 1999

[54] ABRASIVE PAD AND MANUFACTURING METHOD THEREOF AND SUBSTRATE POLISHING METHOD USING SAID ABRASIVE PAD

[75] Inventor: Hideharu Nakajima, Kanagawa, Japan

[73] Assignee: Sony Corporation, Tokyo, Japan

[21] Appl. No.: 09/023,413

[22] Filed: Feb. 13, 1998

[30] Foreign Application Priority Data

Feb. 17, 1997 [JP] Japan ..... 9-031551

[51] Int. Cl.[6] ..... B24B 29/00

[52] U.S. Cl. ..... 451/285; 156/345; 264/258

[58] Field of Search ..... 156/345; 451/288, 451/285; 438/692; 216/88, 89; 264/258

[56] References Cited

U.S. PATENT DOCUMENTS

| | | | |
|---|---|---|---|
| 5,209,760 | 5/1993 | Wiand | 51/293 |
| 5,584,146 | 12/1996 | Shamouillan et al. | 51/293 |
| 5,736,463 | 4/1998 | Sato | 438/692 |

*Primary Examiner*—Bruce Breneman
*Assistant Examiner*—Alva C Powell
*Attorney, Agent, or Firm*—Hill & Simpson

[57] ABSTRACT

An abrasive pad whose abrasive surface has recesses that allow abrasive slurry to stay there is used instead of forming scratches on the abrasive surface of an abrasive pad. This eliminates a dressing operation for forming innumerable scratches on the abrasive surface of an abrasive pad in polishing a wafer. Omitting a dressing step from a wafer polishing process lowers the degree of impurity contamination of a wafer, and eliminating a dresser from a polishing apparatus reduces its cost.

4 Claims, 6 Drawing Sheets

ABRASIVE PAD AND MANUFACTURING METHOD THEREOF AND SUBSTRATE POLISHING METHOD USING SAID ABRASIVE PAD

BACKGROUND OF THE INVENTION

1. Field of the Invention

The present invention relates to an abrasive pad and its manufacturing method as well as to a substrate, a wafer for example, polishing method using the said abrasive pad.

2. Description of the Related Art

Although it is usually desirable from the viewpoint of design that a semiconductor device be as fine as possible, the demand on the depth of focus in lithography step becomes severe. To solve this problem, the resist needs to be improved, which is however difficult. In view of this fact, some methods have been attempted so as to reduce the height differences in device structure. The height differences in device structure cause the difficulty of depth of focus. As one of these methods, in general, height differences in device structure are reduced by chemical mechanical polishing that utilizes a silicon wafer mirror-polishing technique.

The above chemical mechanical polishing will be described below with reference to FIG. 1 which schematically shows the configuration of a chemical mechanical polishing apparatus 10. The chemical mechanical polishing apparatus 10 has a polishing surface table 12 on which an abrasive pad 11 is mounted, a dresser 13, a carrier 14 for holding a wafer 20, and an abrasive slurry supply mechanism 15. Usually, the abrasive pad 11 has a disk-like shape. The polishing surface table 12, which has a short-cylinder-like shape, is rotated while being supported by a polishing surface table rotating shaft 12*a*. Diamonds 13*a* are electrodeposited on a metal plate of the dresser 13. The carrier 14 that holds the wafer 20 is supported by a carrier rotating shaft 14*a* and rotated independently of the polishing surface table 12 or following it. Further, the carrier 14 is equipped with a polishing pressure adjusting mechanism 14*b*. The carrier 14 is thus swung while being pressed against the abrasive pad 11 via the wafer 20. The abrasive slurry supply mechanism 15 supplies abrasive slurry to the surface of the abrasive pad 11 from a supply nozzle 15*a*.

A method for polishing the wafer 20 by using the chemical mechanical polishing apparatus 10 will be described below. First, the polishing surface table 12 is rotated by the polishing surface table rotating shaft 12*a*. At this time, since the abrasive pad 11 and the diamonds 13*a* are in contact with each other, the diamonds 13*a* scrub the surface of the abrasive pad 11 and dress it as the polishing surface table 12 is rotated. The dressing produces innumerable scratches on the surface of the abrasive pad 11. Usually, those portions of the abrasive pad 11 which have been split finely by the scratches are called a dressed layer, and the tips of the split portions are called hair tips of the dressed layer.

When abrasive slurry is supplied from the supply nozzle 15*a* to the surface of the abrasive pad 11 that is formed with the dressed layer, the abrasive slurry stays between the hair tips of the dressed layer. In this state, the carrier 14 that holds the wafer 20 is lowered to approach the abrasive pad 11 while being supported by the carrier rotating shaft 14*a* until the wafer 20 is brought into contact with the abrasive slurry that is provided on the abrasive pad 11. Then, the carrier 14 is swung while being pressed against the abrasive pad 11 via the wafer 20 by the polishing pressure adjusting mechanism 14*b*, whereby the wafer 20 slides on and is polished by the abrasive slurry that is provided on the abrasive pad 11.

However, in the above-described chemical mechanical polishing method, dressing shavings of the abrasive pad 11, diamonds that have dropped from the dresser 13, fragments produced by polishing of the wafer 20 or insulative film, spent abrasive slurry, and like impurities stick to the wafer 20 that is located on the abrasive pad 11 and cause microscratches, which will influence following steps, for example lithography step.

The sticking of those impurities to the wafer 20 is prevented by causing the abrasive slurry to spread to the entire surface to be polished of the wafer 20 and to capture the impurities, and then discharging the abrasive slurry from the abrasive pad 11. In addition, by causing the abrasive slurry to spread to the entire surface to be polished of the wafer 20, insufficiently polished portions are prevented from occurring in the surface to be polished, whereby the polishing rate is made uniform in that surface.

However, the supply of a large amount of slurry is not preferable in terms of cost. And there is another problem that as long as the abrasive pad is dressed, costs are required for repair, maintenance, etc. of the dresser.

SUMMARY OF THE INVENTION

The present invention has been made to solve the above problems in the art and an object of the invention is therefore to provide an abrasive pad and its manufacturing method and a wafer polishing method using the said abrasive pad which make it unnecessary to use a dresser.

The invention provides an abrasive pad to be used for a polishing operation in which a wafer is caused to slide on the abrasive pad while abrasive slurry is supplied to a surface of the abrasive pad and a sliding surface of the wafer is thereby flattened, comprising a plate-like base member; and a plurality of fiber threads made of a fiber material, one ends of the respective fiber threads projecting from a surface of the plate-like base member.

The invention also provides a manufacturing method of the above abrasive pad and a wafer polishing method using the above abrasive pad.

DETAILED DESCRIPTION OF THE PREFERRED EMBODIMENTS

Figure 2A:
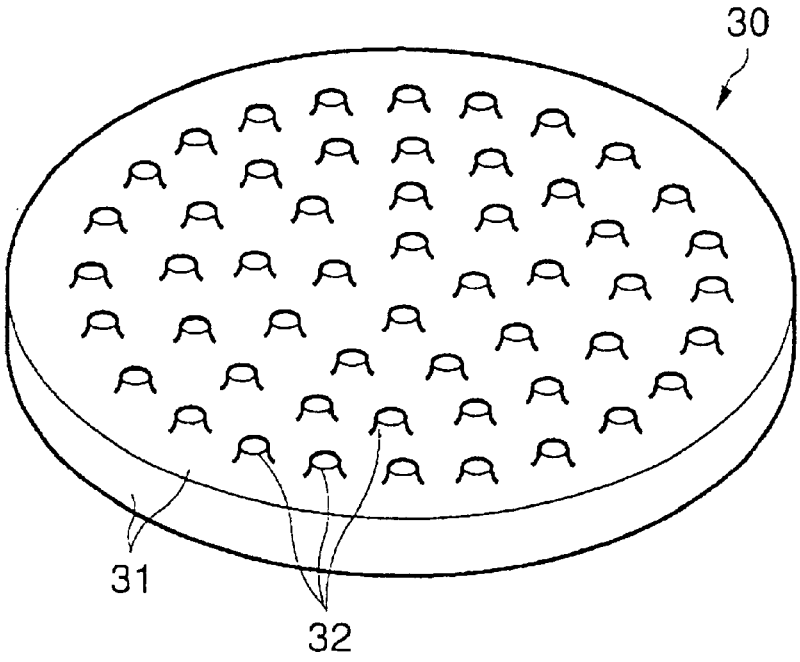
FIGS. 2A and 2B schematically show an abrasive pad according to the present invention.
Figure 2B:
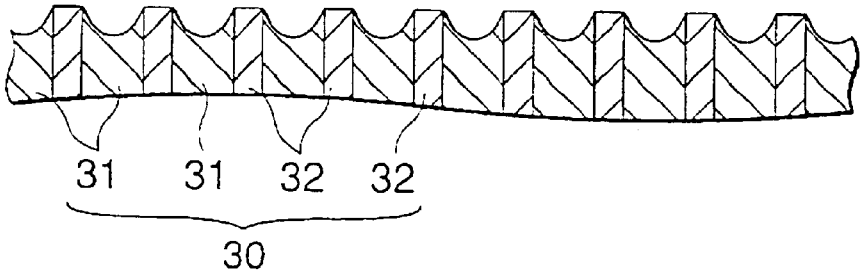
Figure 3B:
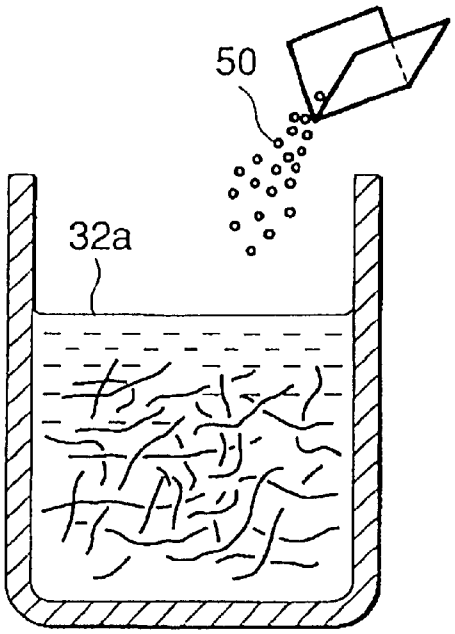
FIGS. 3A and 3B show a step of forming fiber threads in a manufacturing process of an abrasive pad according to the invention.
Figure 3A:
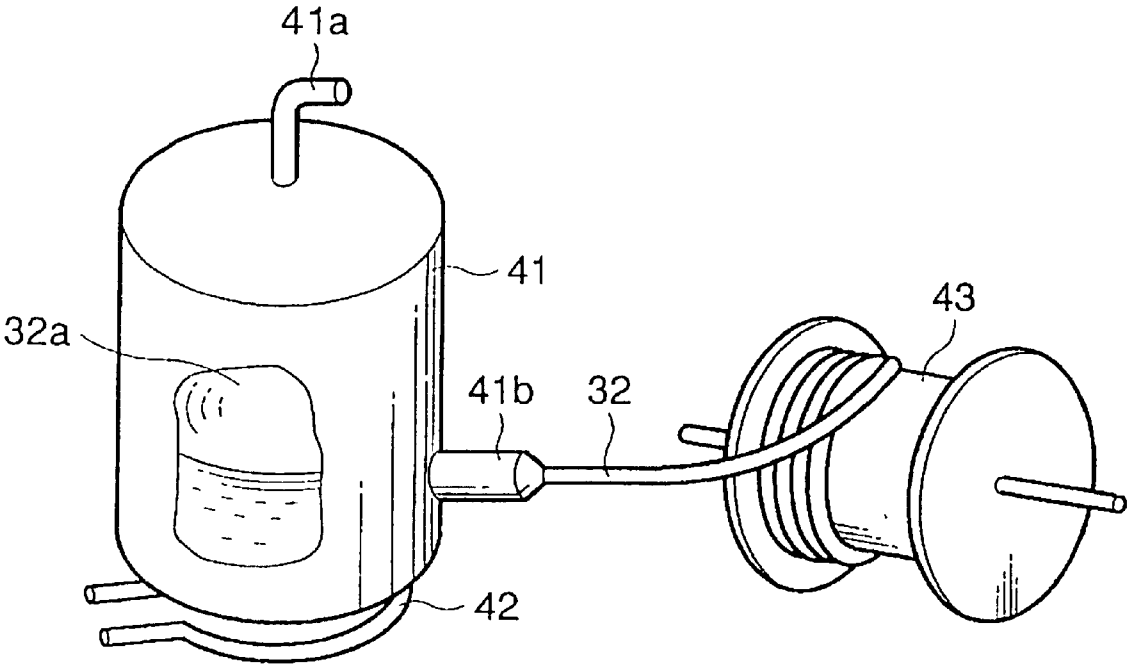
Figure 6:
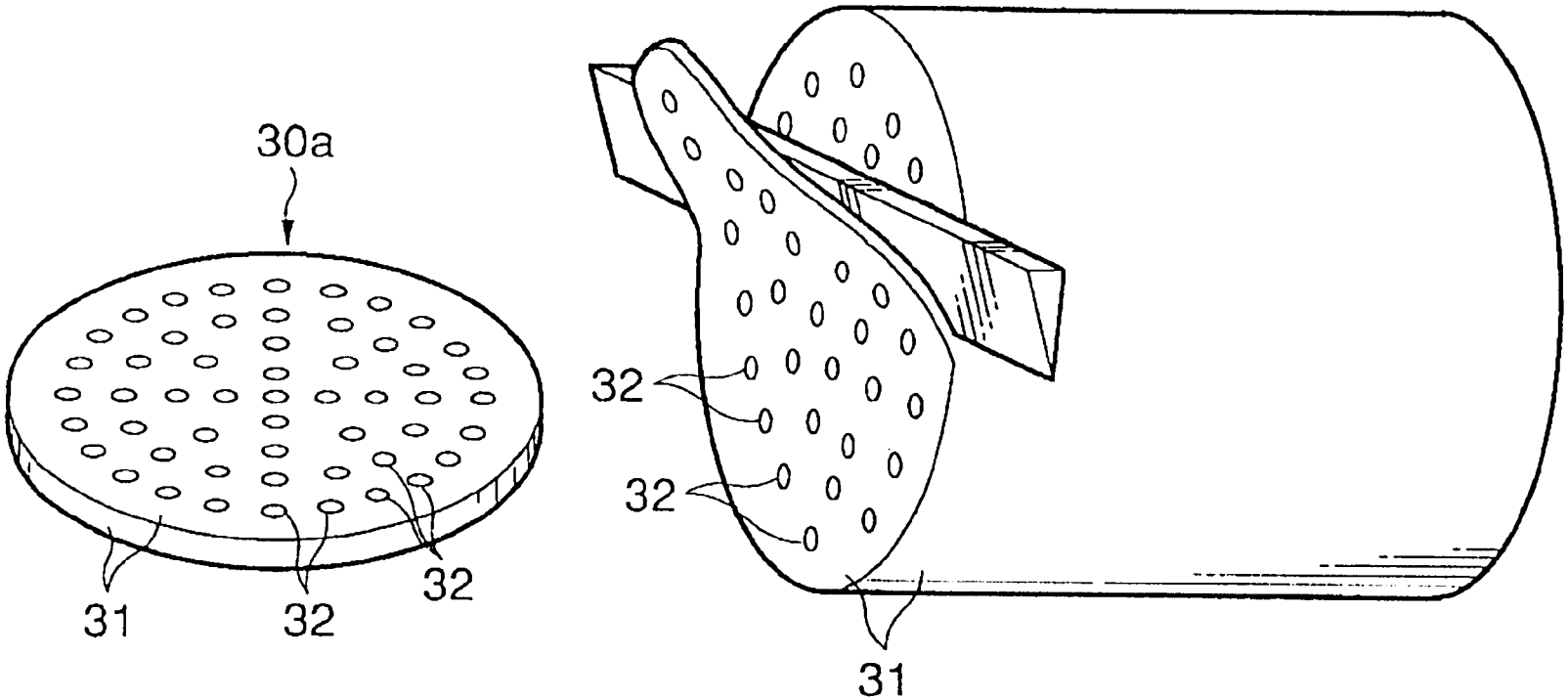
FIG. 6 shows a step of slicing a base member and fiber threads together in the manufacturing process of an abrasive pad according to the invention.

The embodiments of the present invention will be hereinafter described with reference to FIGS. 2A–2B to 6. FIGS. 2A and 2B schematically show an abrasive pad and FIGS. 3A–3B to 6 show a manufacturing process of the abrasive pad.

First, an abrasive pad of the invention will be described. FIGS. 2A and 2B are a perspective view and a sectional view of an abrasive pad 30, respectively.

As shown in FIGS. 2A and 2B, one ends of respective fiber threads 32 project from the surface of a base member 31 at the normal temperature. Therefore, at the normal temperature, there are, on the surface of the abrasive pad 30, projections of the fiber threads 32 and recesses that are formed between the projections.

Next, a manufacturing method of the abrasive pad 30 will be described. FIGS. 3A and 3B show a step of forming the fiber threads 32. As shown in FIG. 3A, a fiber material 32*a* is put in a tank 41 and then melted by heating it with a heater 42 that is disposed under the tank 41.

In this step, instead of putting only the fiber material 32*a*, the fiber material 32*a* mixed with a foaming agent 50 may be put in the tank 41 as shown in FIG. 3B. A substance, such as $CaCO_3$, that generates a safe gas by its thermal decomposition or the like is suitable for use as the foaming agent 50. By heating the tank 41 with the heater 42, the foaming agent 50 is foamed as the fiber material 32*a* is melted.

In a state that only the fiber material 32*a* or the fiber material 32*a* mixed with the foaming agent 50 is left in the tank 41, a gas is introduced into the tank 41 from a pressurizing nozzle 41*a* (see FIG. 3A). As a result, the internal pressure of the tank 41 increases and a molten fiber material 32*a* is jetted from a circular ejection outlet 41*b* of 1–10 $\mu$m in diameter that is attached to the outer surface of the tank 41. The diameter and the sectional shape of the ejection outlet 41*b* are adjusted in accordance of fiber threads 32 desired. The jetted fiber material 32*a* is solidified into a fiber thread 32 by cooling it, for instance, by causing it to be exposed to the air. Where the foaming agent 50 is mixed into the fiber material 32*a*, a fiber thread having hollow portions is obtained. The jetted fiber thread 32 is wound onto a roller 43 and then cut into constant lengths.

When it is not necessary to wind the fiber thread 32, the fiber thread 32 may be placed on a conveyer belt or the like moving at constant speed and cut at a fixed position at given time intervals, to produce constant lengths of fiber threads 32 consecutively. As a further alternative, a plurality of fiber threads 32 may be produced at one time by attaching a plurality of ejection outlets 41*b* to the tank 41 and jetting a molten fiber material 32*a* by pressurizing the inside of the tank 41 for a given period.

Next, a step of molding the base material 31 will be described with reference to FIG. 4. First, a plurality of fiber threads 32 of constant lengths are put in a cylindrical molding container 44. At this time, it is not necessary to arrange the fiber threads 32 of the same diameter at regular intervals as in the case of FIG. 4. For example, the fiber threads 32 may be located on several concentric circles in such a manner that thick fiber threads 32 are located on outer circles and thin fiber threads 32 are located on inner circles. Alternatively, the fiber threads 32 may be arranged radially from the center of the molding container 44 in such a manner that the radial interval gradually increases with the distance from the center. As a further alternative, fiber threads 32 of varied sectional shapes may be arranged spirally. As exemplified above, the diameters, the sectional shapes, and the arrangement positions in the molding container 44 of the fiber threads 32 may be determined freely.

Figure 4:
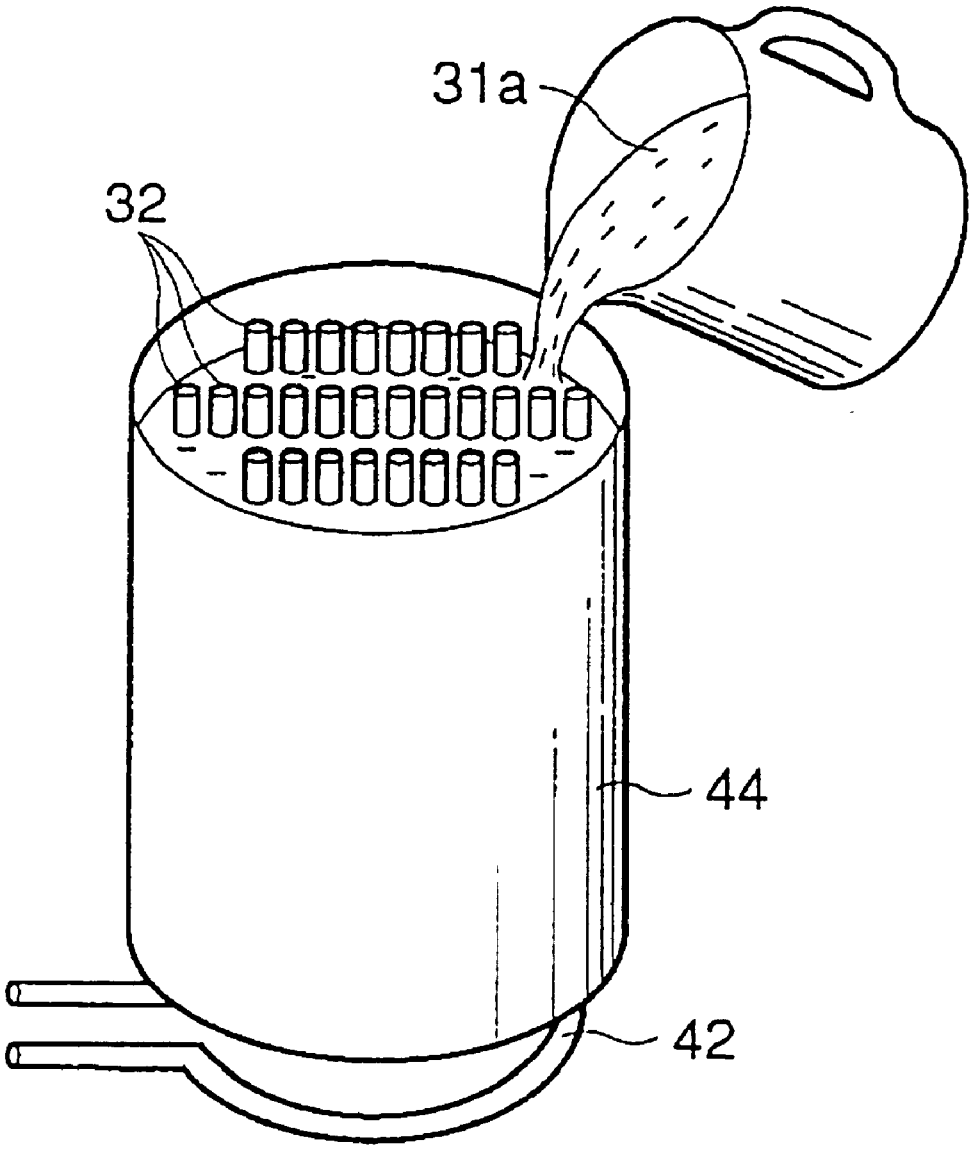
FIG. 4 shows a step of molding a base member in the manufacturing process of an abrasive pad according to the invention.

Then, as shown in FIG. 4, a base member molding material 31*a* that has a larger thermal expansion coefficient than the fiber threads 32 is melted and caused to flow into the molding container 44 that is being heated with a heater 42. The heating temperature is set so as not to exceed the melting temperature of the fiber threads 32. Then, after the base member molding material 31*a* is cooled and thereby solidified (molded), it is removed from the molding container 44, whereby a base material 31 containing the fiber threads 32 is formed. Ordinary abrasive pad materials such as polyurethane materials may be used as the base member molding material 31*a* as long as they have larger thermal expansion coefficients than the fiber threads 32. A base member 31 made of a resin or a foam material may thus be formed.

Figure 5C:
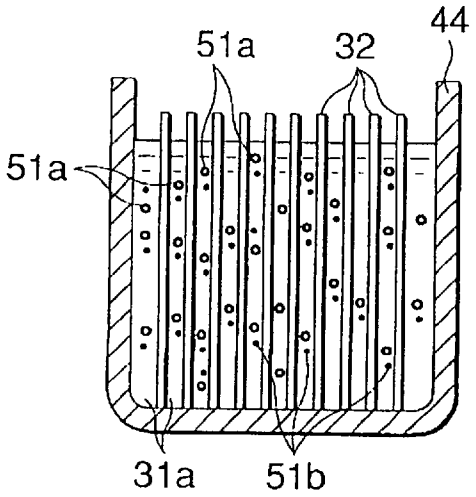
FIGS. 5A–5C show a step of molding a base member in the manufacturing process of an abrasive pad according to the invention.

A modified version of the step of FIG. 4 will be described below with reference to FIGS. 5A–5C. First, as shown in FIG. 5A, a base member molding material 31*a* is melted, a foaming agent 50 such as $CaCO_3$ is mixed into it, and then the base member molding material 31*a* is agitated. It is preferred that the agitation be done at a temperature lower than the foaming temperature of the foaming agent 50.

Figure 5B:
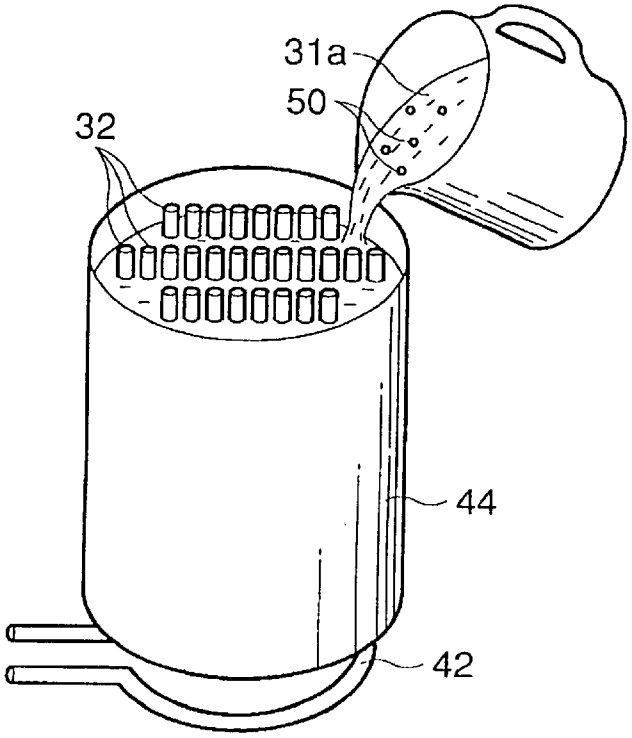
Figure 5A:
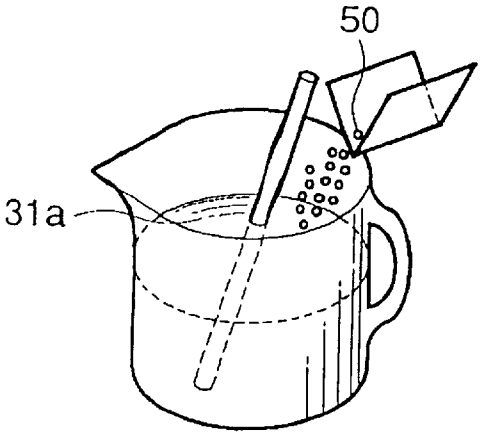

Then, as shown in FIG. 5B, the thus-prepared base member molding material 31*a* that is mixed with the foaming agent 50 is caused to flow into a molding container 44. The base member molding material 31*a* is heated, with a heater 42 that is disposed under the molding container 44, to a temperature higher than the foaming temperature of the foaming agent 50 and lower than the melting temperature of the fiber threads 32, whereby the foaming agent 50 is foamed.

FIG. 5C is a vertical sectional view of the molding container 44 and shows how the foaming occurs. Air bubbles 51*a* (for instance, $CO_2$) and by-products (for instance $CaO_2$) 51*b* both of which are generated as the foaming agent 50 (for instance, $CaCO_3$) is foamed are captured by the base member molding material 31*a*. After the foaming of the foaming agent 50, the base member molding material 31*a* is cooled and solidified (molded) and then removed from the molding container 44, whereby a porous base member 31 containing the fiber threads 32 is formed. The porous state of the base member 31 can be controlled by the mixing ratio of the foaming agent 50.

Next, a step of cutting, i.e., slicing, the base member 31 and the fiber threads 32 that have been obtained by the step of FIGS. 4A–4B or FIGS. 5A–5C into plate members will be described below with reference to FIG. 6. As shown in FIG. 6, a plate member 30*a* that is, for instance, 1–3 mm in thickness and has a smooth surface is obtained by slicing the base member 31 and the fiber threads 32 together perpendicularly to the fiber threads 32 that are captured by the base member 31. This operation is performed at as high a temperature as possible that is lower than the melting temperature of the base member 31.

Since the environmental temperature of the slicing is higher than the normal temperature, the plate member 30*a* as cut out is a circular plate having a smooth surface as shown in FIG. 6. When the plate member 30*a* is cooled to the normal temperature, an abrasive pad 30 having surface asperity as shown in FIG. 2 is obtained because the base member 31 has a larger thermal expansion coefficient and hence contracts to a larger extent than the fiber threads 32.

Figure 1:
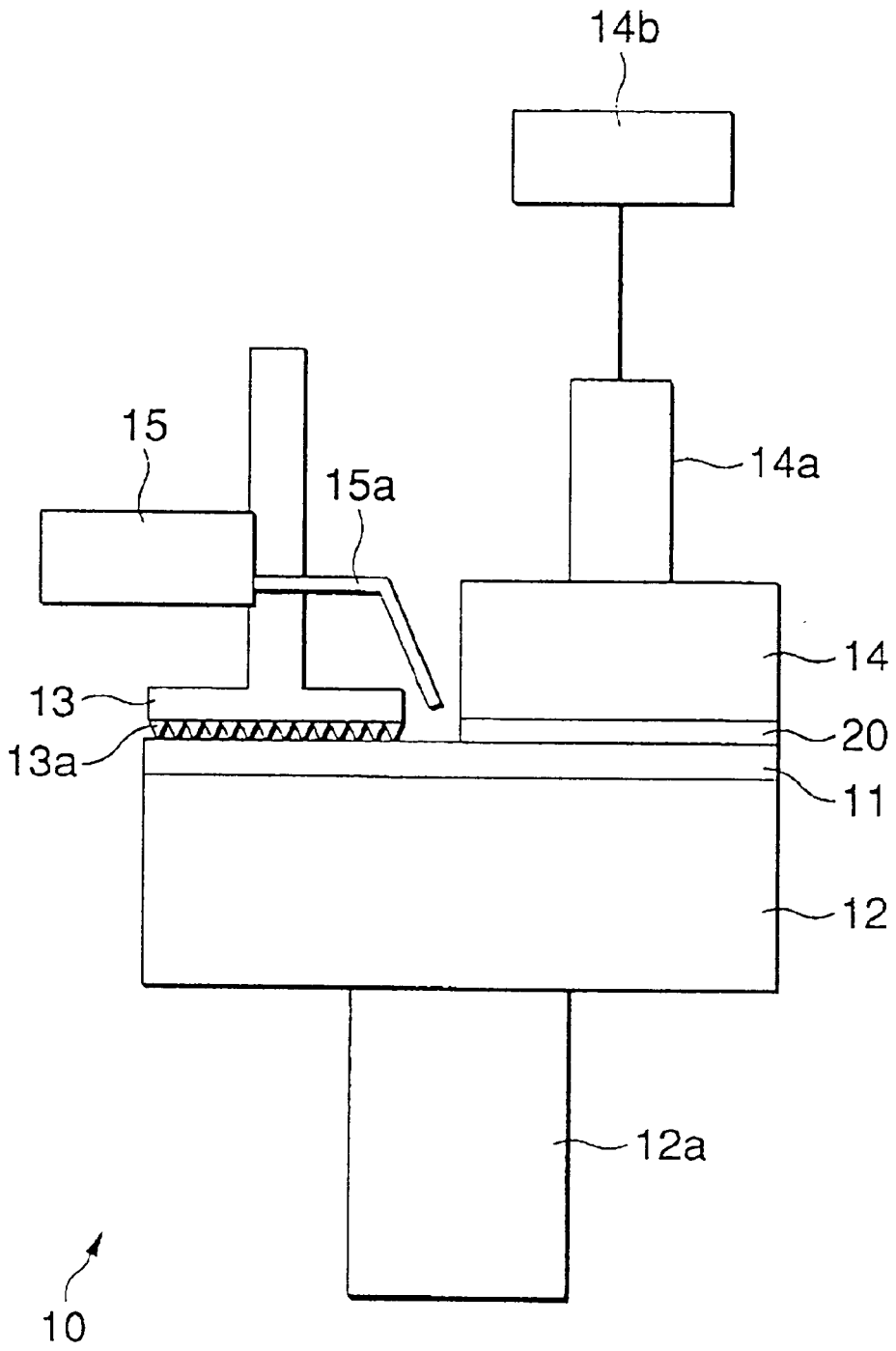
FIG. 1 schematically shows the configuration of a conventional polishing apparatus.

Next, a wafer polishing method using the above-described abrasive pad 30 will be described with reference to FIG. 1. In contrast to the conventional case, in the invention a polishing apparatus 10 need not have the dresser 13 nor the diamonds 13*a* and the abrasive pad 30 is used in place of the abrasive pad 11. The other components that are the same as in the conventional case are given the same reference symbols as in the latter and descriptions therefor will be omitted.

First, the polishing surface table 12 is rotated by the polishing surface table rotating shaft 12*a*. When abrasive slurry is supplied from the supply nozzle 15*a* to the surface of the abrasive pad 30 that is placed on the polishing surface table 12, the abrasive slurry stays in the recesses formed on the surface of the abrasive pad 30. The carrier 14 holding the wafer 20 is lowered to approach the abrasive pad 30 having the recesses where the abrasive slurry stays until the wafer 20 touches the abrasive slurry that is provided on the abrasive pad 30. The carrier 14 is swung while being pressed against the abrasive pad 30 via the wafer 20 by the polishing pressure adjusting mechanism 14*b*. As a result, the wafer 20 is polished as it slides on the abrasive slurry that is held in the recesses of the abrasive pad 30.

As described above, in the abrasive pad of the invention, since one ends of the respective fiber threads project from the surface of the base member, recesses are formed between the projections. Therefore, when abrasive slurry is supplied to the surface of the abrasive pad during a polishing operation, it goes into those recesses and hence stays on the abrasive pad even if no dressing is performed.

Since dressing the abrasive pad is not necessary, a dresser on which diamonds are electro-deposited is not necessary either. Therefore, the cost of the apparatus can be reduced and the cost of the repair, maintenance, etc. of the dresser is no longer required. Further, since sticking to a wafer of impurities that would otherwise be produced by dressing is avoided, leading to a reduction of microscratches to be formed on the wafer. This results in a reduction of an excessive part of abrasive slurry that needs to be supplied to capture impurities and discharge those from the abrasive pad, also contributing to the cost reduction.

At the normal temperature, the base member that constitutes the abrasive pad is contracted as compared to the state of a molten base member molding material during manufacture of the abrasive pad, and hence it is always given tension, i.e., tensile stress. Therefore, the fiber threads that receive weaker tensile stress than the base member project from at least the front surface of the base member, whereby projections and recesses are always formed on the front surface of the abrasive pad. That is, even if the fiber threads are worn away during wafer polishing, asperity is always formed on the front surface of the abrasive pad to allow abrasive slurry to stay in the recesses.

A porous abrasive pad can be obtained by using, as the base member molding material of the invention, a base member molding material mixed with a foaming agent or an ordinary abrasive pad material such as a polyurethane foam material. Hollow portions of such an abrasive pad made of a porous material can hold abrasive slurry in the same manner as in ordinary abrasive pads.

What is claimed is:

1. An abrasive pad to be used for a polishing operation in which a substrate is caused to slide on the abrasive pad while abrasive slurry is supplied to a surface of the abrasive pad and a sliding surface of the substrate is thereby flattened, comprising:

a plate-like base member; and a plurality of fiber threads made of a fiber material, one ends of the respective fiber threads projecting from a surface of the plate-like base member wherein a coefficient of thermal expansion of the base is greater than a coefficient of thermal expansion of the fiber threads.

2. The abrasive pad according to claim 1, wherein the surface of the plate-like member is formed with a plurality of projections and recesses that are formed between the projections, and wherein the abrasive slurry that is supplied to the surface of the abrasive pad is caused to stay in the recesses.

3. The abrasive pad according to claim 1, wherein at least a top layer of the plate-like base member is porous.

4. A manufacturing method of an abrasive pad, comprising the steps of:

molding a base member so that the base member surrounds a plurality of erected fiber threads and fills in a space around the fiber threads;

cutting the base member and the fiber threads together perpendicularly to an erecting direction of the fiber threads, to produce a plate member of a predetermined thickness; and causing recesses to be formed on a surface of the plate member when the base member contracts wherein a coefficient of thermal expansion of the base is greater than a coefficient of thermal expansion of the fiber threads.

* * * * *